US008562248B2

(12) United States Patent
Kleiger

(10) Patent No.: US 8,562,248 B2
(45) Date of Patent: Oct. 22, 2013

(54) METHOD AND APPARATUS FOR REPAIRING POTHOLES AND THE LIKE

(75) Inventor: Scott P. Kleiger, Harleysville, PA (US)

(73) Assignee: Patch Management, Inc., Fairless Hills, PA (US)

( * ) Notice: Subject to any disclaimer, the term of this patent is extended or adjusted under 35 U.S.C. 154(b) by 0 days.

(21) Appl. No.: 12/871,435

(22) Filed: Aug. 30, 2010

(65) Prior Publication Data

US 2011/0070024 A1 Mar. 24, 2011

Related U.S. Application Data

(60) Provisional application No. 61/243,656, filed on Sep. 18, 2009.

(51) Int. Cl.
*E01C 19/18* (2006.01)

(52) U.S. Cl.
USPC ..... 404/108; 404/101; 404/107

(58) Field of Classification Search
USPC ..... 404/101, 107–111, 83; 414/221, 217, 414/219; 239/654
See application file for complete search history.

(56) References Cited

U.S. PATENT DOCUMENTS

| | | | | |
|---|---|---|---|---|
| 2,791,339 | A * | 5/1957 | Sprague | 414/526 |
| 3,712,681 | A * | 1/1973 | Marino et al. | 406/48 |
| 4,363,427 | A | 12/1982 | Crosby | |
| 4,511,284 | A * | 4/1985 | Sterner | 404/111 |
| 4,630,929 | A * | 12/1986 | Medlin | 366/10 |
| 4,708,519 | A | 11/1987 | Davin et al. | |
| 4,817,870 | A | 4/1989 | Dalton | |
| 5,419,654 | A | 5/1995 | Kleiger | |
| 5,439,313 | A * | 8/1995 | Blaha et al. | 404/75 |
| 5,494,510 | A | 2/1996 | Kuc, Sr. | |
| 5,556,237 | A * | 9/1996 | Rexius | 406/32 |
| 5,725,160 | A * | 3/1998 | Harper et al. | 239/654 |
| 6,089,795 | A * | 7/2000 | Booth | 406/43 |
| 6,666,627 | B1 * | 12/2003 | Wysong | 406/98 |
| 7,275,893 | B2 * | 10/2007 | Rexius et al. | 406/197 |
| 7,481,601 | B2 * | 1/2009 | Gilchrist | 404/109 |
| 2008/0031688 | A1 * | 2/2008 | Gilchrist | 404/108 |
| 2008/0035177 | A1 | 2/2008 | Kleiger et al. | |
| 2009/0274545 | A1 | 11/2009 | Liess et al. | |

OTHER PUBLICATIONS

Notification of International Preliminary Report on Patentability dated Jun. 14, 2012 from corresponding International Patent Application No. PCT/US10/47505.

* cited by examiner

*Primary Examiner* — Matthew D Troutman
(74) *Attorney, Agent, or Firm* — Volpe and Koenig, P.C.

(57) ABSTRACT

A vehicle mounted patching system for patching potholes and the like and incorporating method and apparatus for feeding materials used in patching operations as well as removing and flushing asphalt emulsion from the feed lines of the patcher vehicle to completely recycle the cleaning agent used to flush the feed lines after a patching operation, as well as preventing any external discharge of potentially toxic materials. Dry particulate is used to coat a pothole patch to permit immediate use. Rubber particulate impregnated with a fibrous material is used to assure bonding with the emulsion. A hydraulically-driven feeder feeds particulate into a pressurized conduit through a one-way air lock. A hydraulic pump provides mechanical power to the feeder and an air blower which pressurizes the conduit carrying the particulate to a dispensing head. A spray assembly is provided to spray fibrous material entering the feeder.

15 Claims, 11 Drawing Sheets

METHOD AND APPARATUS FOR REPAIRING POTHOLES AND THE LIKE

CROSS REFERENCE TO RELATED APPLICATION

This application claims the benefit of U.S. Provisional Application No. 61/243,656 and filing date of Sep. 18, 2009, which is incorporated by reference as if fully set forth.

FIELD OF INVENTION

The present invention relates to patching devices, and more particularly, to vehicle mounted patching systems for patching potholes and the like and incorporating a novel method and apparatus for providing a protective top layer.

BACKGROUND

Asphalt patching systems are well known in the art. For example, U.S. Pat. No. 5,263,790 issued Nov. 23, 1993 and U.S. Pat. No. 5,419,654 issued May 30, 1995, teach a patcher comprising a motor driven, wheeled vehicle having a gravel hopper for holding aggregate and a storage tank for liquid emulsion, typically asphalt, as well as pressurized conduits for respectively advancing gravel and asphalt to a mixing head. The asphalt emulsion is delivered from the storage tank to the mixing head by feed lines. The mixing head is arranged to extend from a free end of a swingably mounted, telescoping boom, which is moveable in both horizontal and vertical planes as well as being selectively extendable and retractable to expedite desired positioning of the mixing head above a roadway surface to be patched, i.e., repaired. The pressurized conduits may also be initially employed to blow debris from the pothole or crevice prior to being repaired whereupon an emulsion such as asphalt, with or without aggregate, is delivered to the mixing head. The need for rolling or tamping is eliminated by the use of high-pressure air.

Present day techniques for repairing a pothole includes:

a) clearing debris from the pothole;

b) coating the pothole surface with an emulsion;

c) filling pothole with admixed emulsion and a suitable aggregate; and d) coating top surface of the filled pothole with pulverized stone.

Due to the need to return roadways to use as quickly as possible after a repair operation, it is nevertheless disadvantageous to use a top coat of pulverized stone since tires of passing vehicles often kick up the pulverized stones into other vehicles causing damage to front, rear or side windows, doors, fenders and the like. Also the top layer of crushed stone contrasts with the darker, surrounding road surface.

It is therefore desirable to provide method and apparatus for repairing a pothole which enables immediate use of the repaired surface while preventing damage to vehicles passing along the repaired surface and to provide a repair which blends into the road surface. In addition, the apparatus described herein is capable of performing the novel method requiring a minimal amount of operator intervention.

SUMMARY

The method and apparatus for performing the method of the present application comprises a vehicle mounted patching system for patching potholes and the like and incorporating method and apparatus for feeding materials used in patching operations as well as removing and flushing asphalt emulsion from the feed lines of the patcher vehicle to completely recycle the cleaning agent used to flush the feed lines after a patching operation, as well as eliminating any external discharge of potentially toxic materials.

BRIEF DESCRIPTION OF THE DRAWINGS AND PREFERRED EMBODIMENTS THEREOF

The embodiments of the present invention will be understood from a consideration of the detailed description and drawings, wherein like elements are designated by like numerals, and wherein.

DETAILED DESCRIPTION OF THE PREFERRED EMBODIMENTS

Figure 1A:
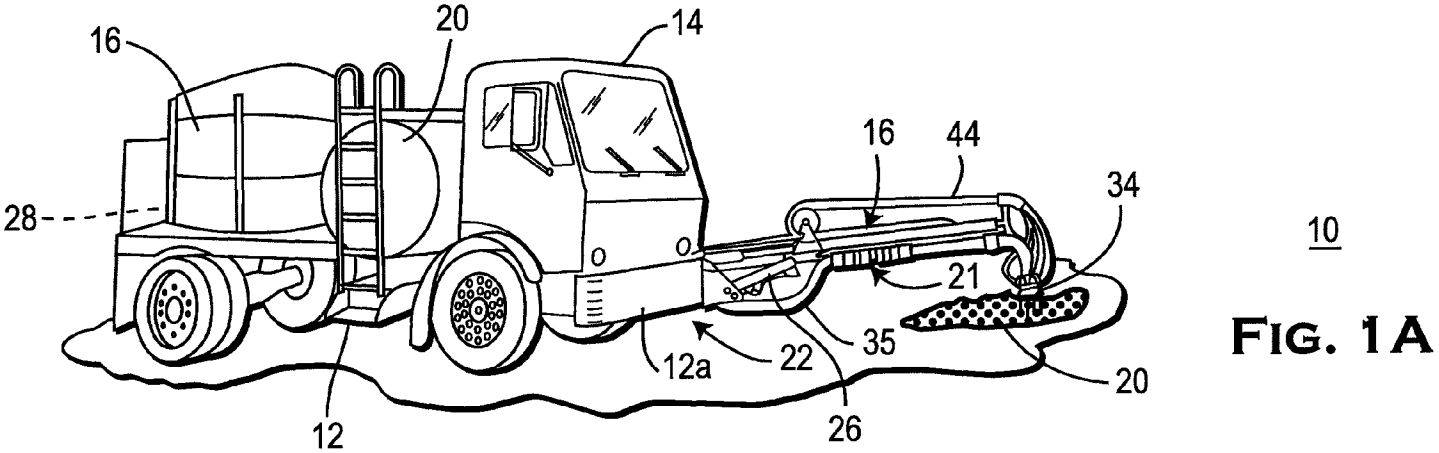
FIGS. 1A, 1B and 1C are perspective views of a patching vehicle embodiment utilizing the novel cleaning technique of the present invention.
Figure 1B:
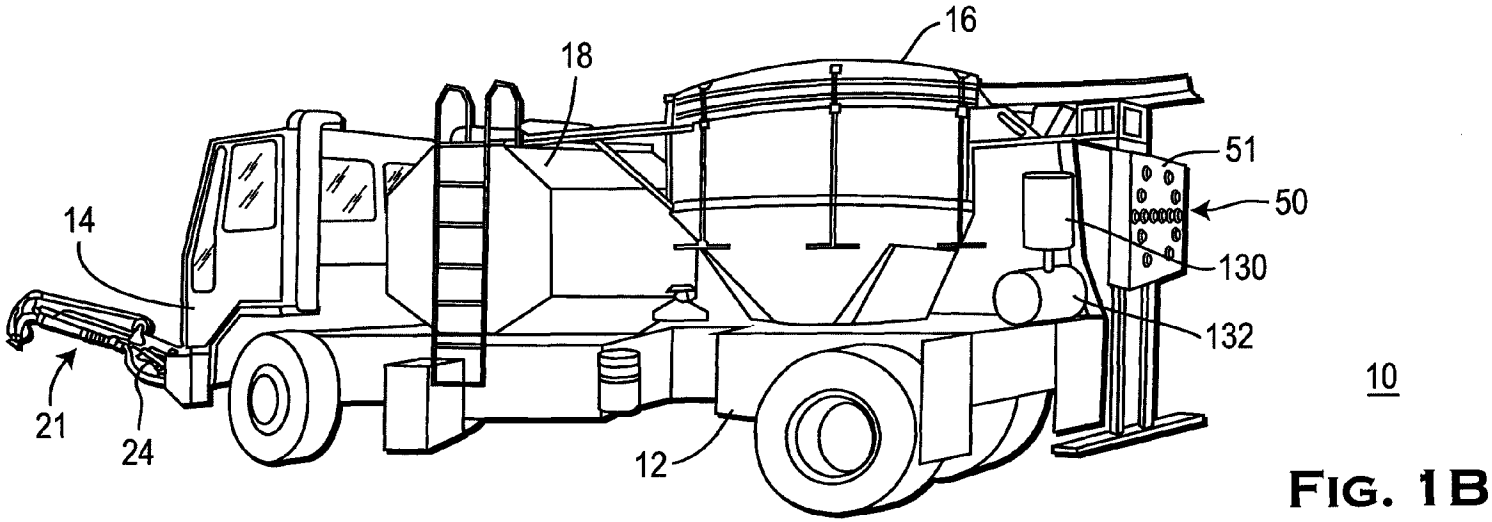
Figure 1C:
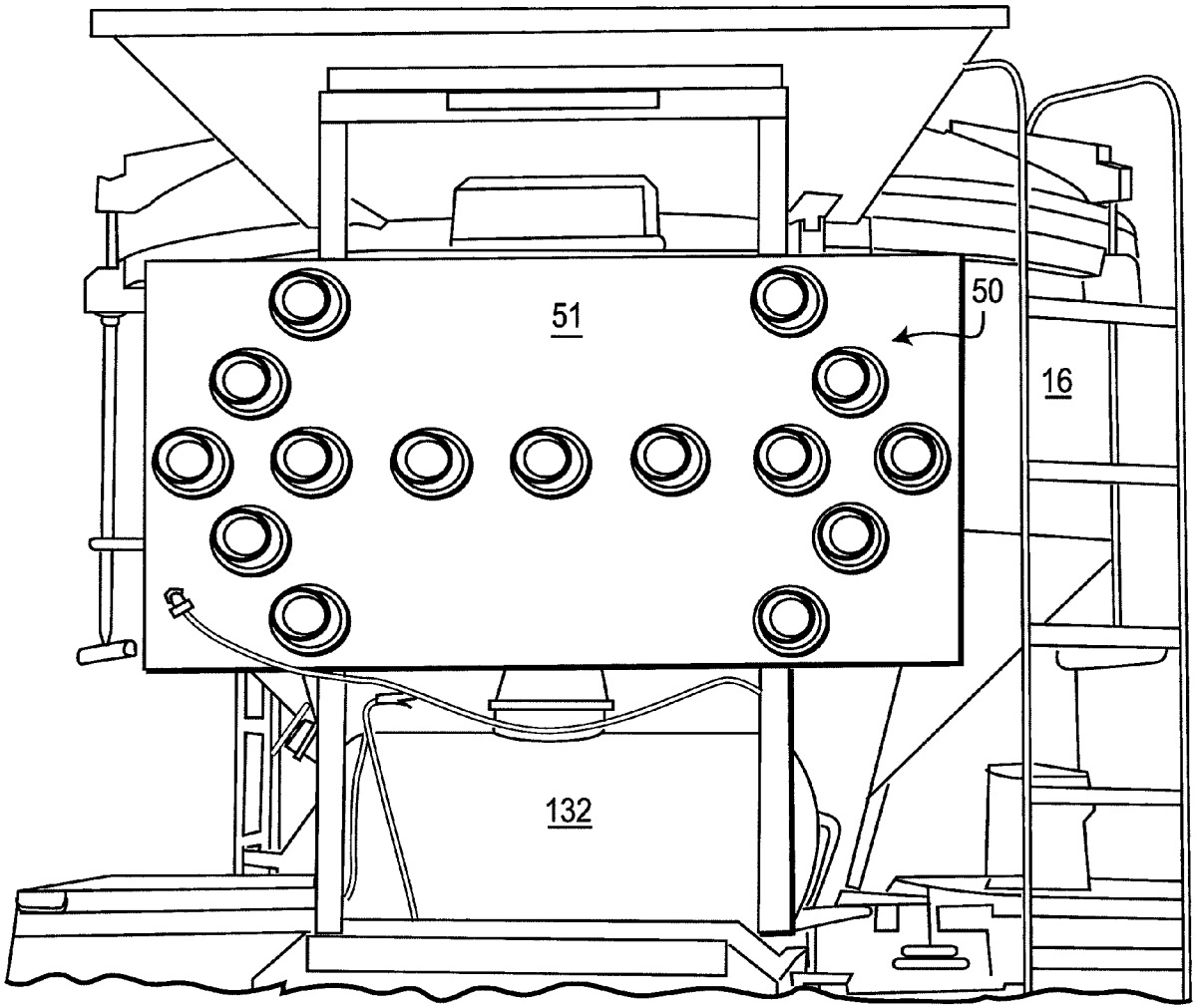

FIGS. 1A-1C are perspective views showing a vehicle (i.e., a "patcher") 10 for patching roadways and the like, typically through the use of an asphalt-gravel mixture and comprised of a wheeled, self-propelled vehicle including a chassis 12 and a cab, 14 containing the vehicle engine (not shown), which is any suitable engine employing an engine cooling system using liquid coolant (such as water or a water/anti-freeze mixture.)

Chassis 12 supports a gravel hopper 16 and an enclosure 18 of substantially hexagonal shape which contains an asphalt supply tank 20. The asphalt is normally heated to maintain a temperature of the order of 135 to 160 Degrees F.

Figure 2A:
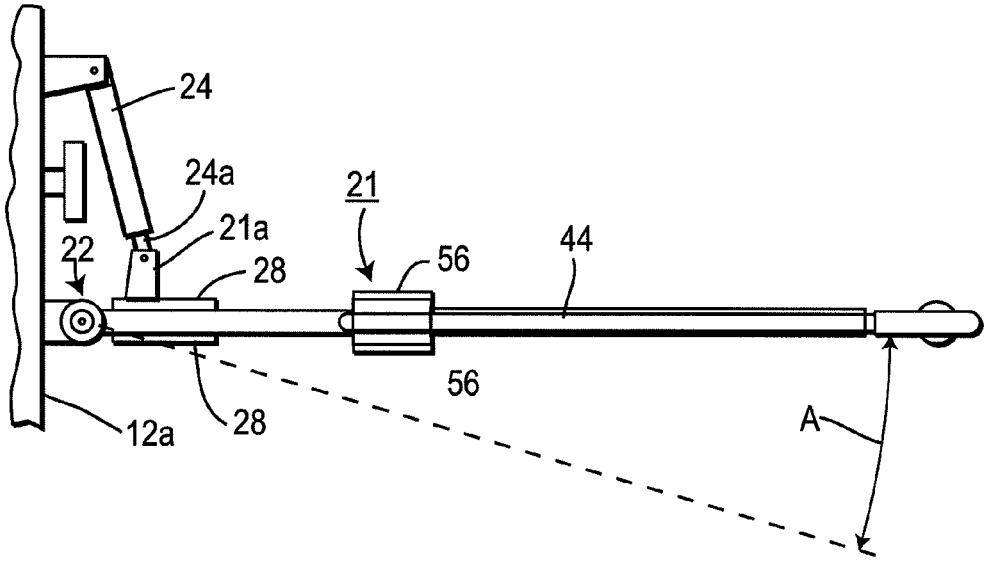
FIGS. 2A and 2B show the mixing head and boom of FIGS. 1A and 1B in greater detail.

A front boom assembly 21 is pivotally mounted to the front end of the cab 14 to enable the boom assembly to swing in a horizontal plane by means of pneumatic cylinder 24, shown in FIG. 2A. Boom assembly 21 is further swingable in a vertical plane under control of cylinder 26, detailed views of the boom assembly 21 and activating cylinders 24 and 26 being respectively shown in FIGS. 2A and 2B.

A flexible hose 35 communicates between gravel hopper 16 and a mixing head 34 arranged at the free end of boom assembly 21. Flexible hose 35 couples gravel hopper 16 to mixing head 34 through a telescoping delivery assembly 36.

The details of the movement of the boom assembly and its various components are set forth in U.S. Pat. No. 5,419,654 which is incorporated herein by reference and further details of the boom assembly and its operation are omitted herein for purposes of simplicity.

It is sufficient to understand, however, that a heated asphalt emulsion and aggregate are respectively fed to the mixing head under suitable air pressure as will be described in detail below.

The hollow, insulated non-collapsible hose 44 typically contains five (5) different fluid carrying lines as well as electrical wires as will be described below in greater detail. Non-collapsible hose 44 is maintained substantially taut regardless of the expansion or retraction of the telescoping delivery tube assembly 36, under control of piston cylinder 16, as is described in detail in the aforementioned issued U.S. Pat. No. 5,419,654.

FIG. 1C shows a rear view of patcher 12 which is provided with an array 50 of red lights mounted upon panel 51 which, when selectively illuminated, appear as left-hand and right-hand arrows to guide vehicles approaching from the rear to either the left or the right (or both the left and right) around the truck as it is performing patching operations.

Figure 3:
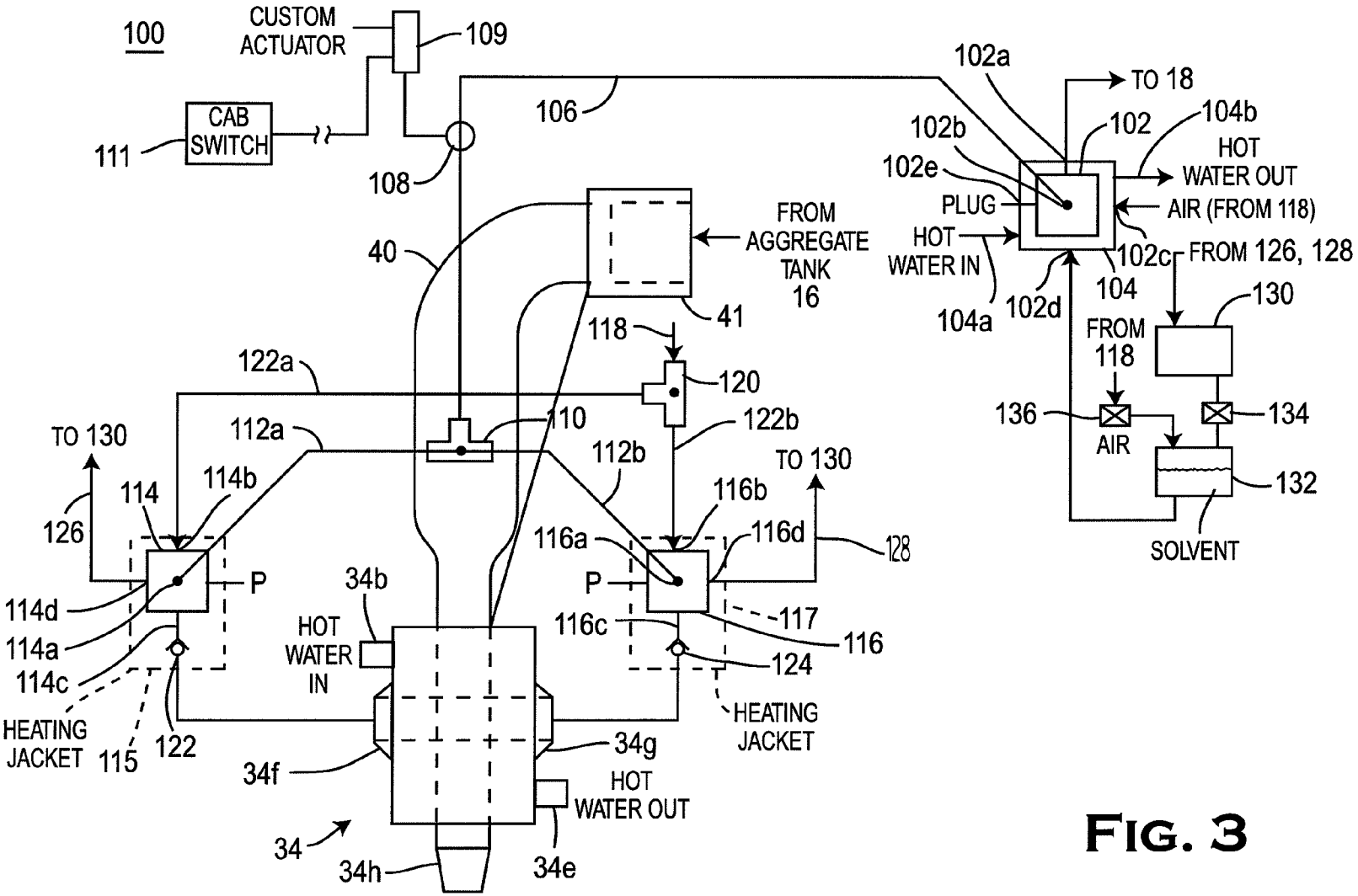
FIG. 3 is a simplified schematic diagram embodying some of the principles of the present invention and which is useful in describing the cleaning procedure of the present application.

FIG. 3 shows a simplified schematic diagram which is useful in explaining the normal patching operations, including the manner in which the feed lines carrying asphalt emulsion are emptied of emulsion and flushed by a cleaning agent, both of which materials are fully recycled, thereby totally avoiding the need to drain any of the emulsion residue or solvent employed in the flushing operation. In other words, a fully self-contained system is provided for performing the cleaning and flushing operations and no fluids or residue are emitted to the atmosphere nor do they leave the self-contained system during the performance of the air cleaning and flushing operations.

Figure 2B:
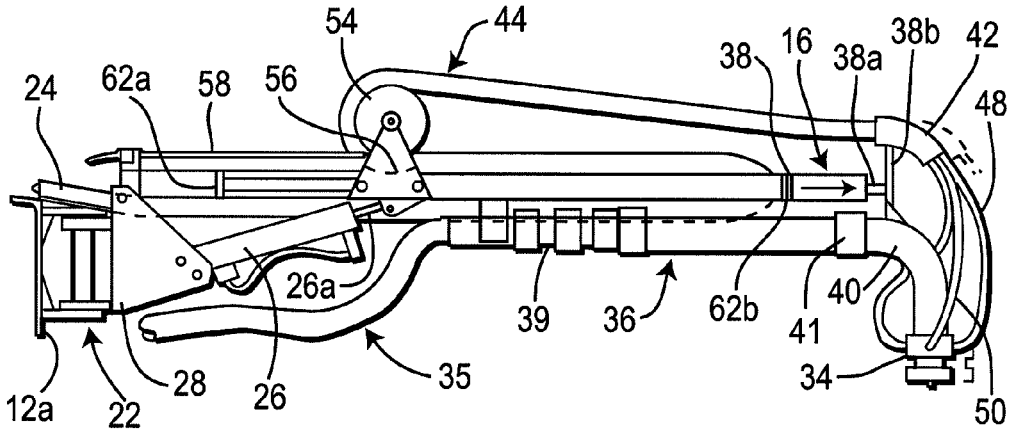

As was described above, the aggregate hopper 16 is coupled to the mixing head 34 by means of the telescoping assembly 36 also shown, for example, in FIG. 2B and provided at its free end with curved tube 40 joined to the telescoping assembly 36 by coupling collar 41. Coupling collar 41 and the curved tube member 40 are shown in FIG. 3 wherein aggregate from hopper 18 passes through coupling 41 and curved tubing 40 and enters into the hollow interior 34*a* of mixing head 34 with the aid of pressurized air.

Figure 3A:
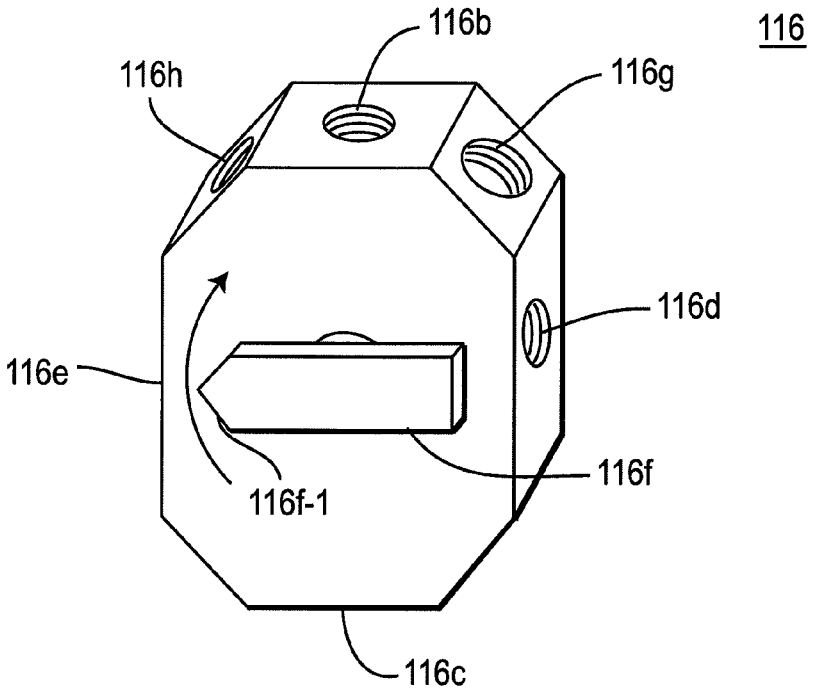
FIGS. 3A-3D show various components of the schematic diagram of FIG. 3 in greater detail.
Figure 3B:
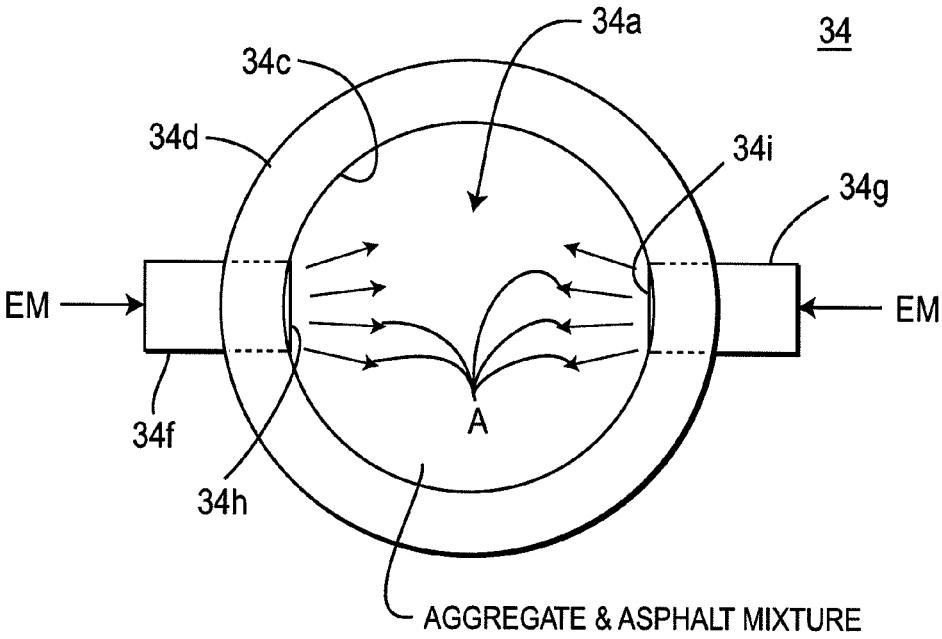

Coolant from the engine cooling system of the patcher 10, which is typically heated to a temperature in the range of 135-160 and preferably 150 degrees F., enters into a hot water inlet coupling 34*b* and circulates through the hollow interior of the mixing head defined by the inner and outer cylinder walls 34*c* and 34*d*, shown in FIG. 3B, leaving the mixing head by way of coupling outlet 34*e* which returns the cooling fluid through a suitable conduit to the engine radiator, not shown, and forming part of the engine cooling system employed for driving the vehicle which is also not shown for purposes of simplicity.

The emulsion storage tank 18 is coupled to an inlet port 102*a* of a multi-port valve 102 having a common outlet port 102*b* which is selectively coupled to one of the ports respectively arranged at 3 o'clock, 6 o'clock, 9 o'clock and 12 o'clock positions about the sidewalls of valve 102. Valve 102 is preferably enclosed within an insulating jacket 104 having inlet and outlet ports 104*a* and 104*b* for respectively introducing hot water from the engine cooling system into jacket 104 and for returning the hot water to the engine cooling system. The hot water flowing through jacket 104 maintains asphalt emulsion passing through valve 102 in a heated, flowable condition to prevent clogging of the valve 102.

When valve 102 is moved to the position coupling 12 o'clock port 102*a* to common port 102*b*, heated asphalt from tank 18 passes through valve 102 and enters asphalt line 106, which is one of the lines that is enclosed within the hollow, insulated non-collapsible hose 44, shown in FIG. 2B.

A valve assembly, preferably a one-half inch (0.50") ball valve assembly 108, is connected in line 106 and is operated under the control of a custom linear actuator 109 operated under control of an actuator switch 111 located in the patcher cab 14 to provide an adjustable flow rate of the asphalt emulsion through line 106. Line 106 is split by a T-coupler 110, providing a first branch 112*a* which is coupled to the common inlet port 114*a* of control valve 114 and a second branch 112*b* coupled to common inlet port 116*a* of control valve 116.

Multi-position control valves 114 and 116, as well as valve 102, are substantially identical in design and function, as will be more fully described in connection with FIG. 3A. Valves 102, 114 and 116 are each respectively enclosed within a heating jacket 104, 115, 117 each of which are electrically heated to maintain the asphalt emulsion in a heated, flowable state and thereby prevent freezing of asphalt in these valve structures when patcher 10 is shut down and stored overnight or during weekends, in cold temperature regions, by coupling the electrically operable heating jackets to a suitable power source (not shown).

FIG. 3A is a perspective view of one of the four-position control valves, such as valve 116, it being understood that both control valves 114 and 116 (as well as valve 102) are substantially identical in design and function, and it being further understood that the positions of the outlet ports of valves 114 and 116 in FIG. 3 are symmetrical about an axis of symmetry which is coaxial with a central axis of mixing head 34. Only one control valve will be described in detail for purposes of simplicity.

The control valve 116 shown in FIG. 3A is a substantially solid block provided with ports 116*b*, 116*d*, 116*c* and 116*e*, respectively arranged at 12 o'clock, 3 o'clock, 6 o'clock and 9 o'clock positions around the top, right-hand, bottom, and left-hand side surfaces of the control valve 116. An operating handle 116*f* is mounted along the front face of the control valve and may be selectively positioned in one of the 12, 3, 6 and 9 o'clock positions. The control valve 116 is provided with a common inlet opening 116*a* along its rear surface. By positioning the control valve operating handle so that its tapered shape tip 116*f-l* is aligned with one of the four (4) given positions 116*b*-116*e*, that port communicates with common port 116*a* in accordance with the alignment of the rotatable operating handle 116*f*.

The valve assembly 116 comprises a hollow housing and is further provided with a pair of openings 116*g* and 116*h* along respective diagonal side surfaces for receiving coolant from the patcher engine cooling system to heat the valve and thereby maintain asphalt passing through the control valve 116 during a patching operation to be in a heated, flowable state and thereby prevent the control valve 116 (as well as control valves 114 and 102) from becoming clogged with cooled emulsion.

An air supply line 118 derives air under pressure directly from the air brake supply of the patcher air brake system (i.e., without any reduction in pressure), not shown for purposes of simplicity. Air pressure of the order of 120 psi is supplied to the air line 118. A T-coupler 120 feeds the pressurized air to branch lines 122*a* and 122*b*, each of which are respectively coupled to inlet ports 114*b* and 116*b* of multi-position valves 114 and 116.

Ports 114*c* and 116*c* of multi-position valves 114 and 116 are respectively coupled through one-way valves 122 and 124 to one of the inlets 34*f* and 34*g* which extend through outer and inner jacket walls 34*c* and 34*d* of mixing head 34 (see FIG. 3B) in order to introduce asphalt emulsion at diametrically opposed openings provided along the inner and outer jackets 34*c* and 34*d* and thereby introduce asphalt emulsion into the hollow interior of the mixing head 34. Suitable dispersing members 34*h* and 34*i*, shown in FIG. 3B, are substantially flush with the interior jacket 34*c*, to disperse the asphalt emulsion throughout the hollow interior of the mixing head, as shown by arrows A, to coat the aggregate fed into mixing heat 34.

As was previously mentioned, the aggregate passes through curved member 40 and into the hollow interior of mixing head 34 where the aggregate is admixed with and coated by the liquid emulsion and then passes through the outlet end 34*h* of the mixing head 34 for deposit into a pothole or other crevice or recess being and/or repaired. As was mentioned above, air under pressure may be introduced into mixing head 34 while the emulsion feed lines and aggregate line are closed, to clean debris from a pothole. Also, air under pressure enters the flexible hose 35 and telescoping assembly 36 to advance the aggregate into the mixing head 34.

Check valves 122 and 124 are preferably respectively coupled between outlet ports 114*c* and 116*c* and couplings 34*f* and 34*g*, allowing emulsion to pass in only one direction and enter into the mixing chamber of mixing head 34 while preventing any reverse flow of the asphalt emulsion from the mixing head back into the control valves 114 and 116 through ports 114*c*, 116*c*.

The one-way check valves 122 and 124 are preferably provided with jackets having inlet and outlet ports similar to the ports 116*g* and 116*h* of valve 116, as shown in FIG. 3A, to receive coolant to heat the check valves during patching operations. For simplicity, check valves 122 and 124 are shown as being enclosed within the heating jackets 115 and 117, but may be provided with their own heating jackets, which maintain any asphalt emulsion within the jackets in the heated, flowable state regardless of the ambient temperature and thereby prevent the one-way valves from becoming clogged with cooled emulsion. Check valves 122 and 124 have a housing provided with inlet and outlet openings similar to the openings 116*g*, 116*h* provided in housing 116 shown in FIG. 3A, to receive coolant to heat the check valves and heat the emulsion flowing therethrough in the same manner as valve 116.

Control valves 114 and 116 are further provided with outlet ports 114*d* and 116*d*. Back flush conduits 126 and 128 are coupled between ports 114*d*, 116*d* and recovery tank 130. Flush tank 132 contains solvent under pressure, employed for flushing the feed lines 106, 112*a* and 112*b*. Recovery tank 130 is located above flush tank 132 to provide for the flow of fluid by gravity from recovery tank 130 to flush tank 132, when normally-closed valve 134 is open. Any suitable cleaning agent having cleansing and/or flushing capabilities may be used.

Patcher 10 operation is initialized by assuring that air pressure provided to the asphalt storage tank 18 and the flush tank 132 are within the range of 50-70 psi and that the air brake system is developing air pressure in the range of 100-120 psi. Valve 136, coupled near the outlet of the air brake pressure source 118, is a regulator valve which, when open, regulates the output pressure introduced into the flush tank 132 and the asphalt storage tank 18, through valve 102, to obtain the desired pressure levels mentioned above. The control arms of valves 114 and 116 are then placed in the 12 o'clock position, causing air entering conduits 122*a* and 122*b* to pass through valves 114 and 116 and enter into the feed lines 112*a* and 112*b*. The air brake pressure source fed to the line 118 and entering T-coupler 120 bypasses the valve 136 and thus provides maximum pressure (i.e., 100-120 psi) entering the 12 o'clock ports 114*b*, 116*b* of valves 114 and 116 and exiting common ports 114*a*, 116*a*, lines 112*a*, 112*b* and coupler 110, to clear line 106. The control arm of valve 102 is then placed in the 12 o'clock position. The actuator switch 111 in the patcher cab 14 (see FIG. 3) is operated to activate linear actuator 109 and open ball valve 108. Air blows through the valves 102, 114, 116, and feed lines 112*a*, 112*b* and 106, clearing valves 102, 114 and 116 and feed lines 106, 112*a* and 112*b* of any emulsion. The air pressure in the feed lines drops after 1-2 minutes. The pressure is monitored by a pressure gauge (not shown) in cab 14. The ball valve 108 is then closed by operating switch 111. Thereafter, the operating arms of both valves 114, 116 are moved to the 6 o'clock position in readiness for a patching operation. Emulsion may take approximately 30 seconds to flow to mixing head 34 since air may still be in the feed lines.

During a typical patching operation, a pothole in the roadway surface is cleaned by blowing high-volume air into the pothole. Air under pressure is introduced into feed line 106 from port 102*c* and common port 102*b* by placing the operating arm of valve 102 in the 3 o'clock position and placing the operating arms of valves 114 and 116 in the 6 o'clock position, enabling air under pressure to exit through dispensing head 34.

In a second step, a tack coat of emulsion may be applied to the surface of the area to be treated.

In a third step, a mixture of aggregate admixed with heated emulsion is emitted from the mixing head 34 to fill the pothole. The operating arm of valve 102 is then placed in the 12 o'clock position and valves 114 and 116 are placed in the 6 o'clock position to cause emulsion to flow (under pressure) from the supply tank 18 to mixing head 34 through 102, 106, 112*a*, 112*b*, 114, 116 and 112-124.

A finished coat of a dry material may then be applied. The 3 o'clock port of valve 102 can also receive air to blow out the feed line 106, if desired. It has been found that sprayed injection patching is the most economical and longest lasting method for pothole repair.

In order to clean the internal lines of asphalt emulsion while at the same time eliminating any external discharge of fluid from the system and completely recycling the asphalt and solvent, control valves 102, 114 and 116 are operated in the following manner:

A shut-down storage operation is initiated by introducing air into the feed lines by operating switch 111 in cabin 14 to fully close the ball valve 108. The operating handles of control valves 102, 114 and 116 are respectively moved to the 3 o'clock, 12 o'clock and 12 o'clock positions. Ball valve 108 is then opened and maintained open for approximately 1 to 2 minutes until the air pressure in the feed lines drops (monitored by an air pressure gauge in cab 14) whereupon the ball valve 108 is fully closed.

Valves 114 and 116 are then respectively moved to the 9 o'clock and 3 o'clock positions. The operating arm of control valve 102 is then moved to 6 o'clock position, coupling flush tank 132 to feed line 106 through ports 102*d*, 102*b* of valve 102 in readiness to perform a flushing operation. Actuator 109 is operated to open ball valve 108, causing solvent in pressurized flush tank 132 to enter the 6 o'clock port 102*d* of valve 102 and pass through valve 102, feed lines 106, 112*a* and 112*b* and valves 114 and 116 and then to recovery tank 130 through back flush lines 126 and 128. One of these hoses, such as hose 128, is preferably formed of a clear transparent material, enabling an operator to view the cleaning agent as it moves from flush tank 132, through valve 102, feed lines 106, 112*a*, 112*b*, valves 114 and 116 and back flush lines 126, 128 and enter into recovery tank 130, shown in FIGS. 1C, 3, 3C and 3D. The asphalt is cleansed from line 106 and valves 114, 116 by the cleaning agent as can be viewed passing through the clear hose 128. The ball valve 108 is then returned to the closed position.

Figure 3C:
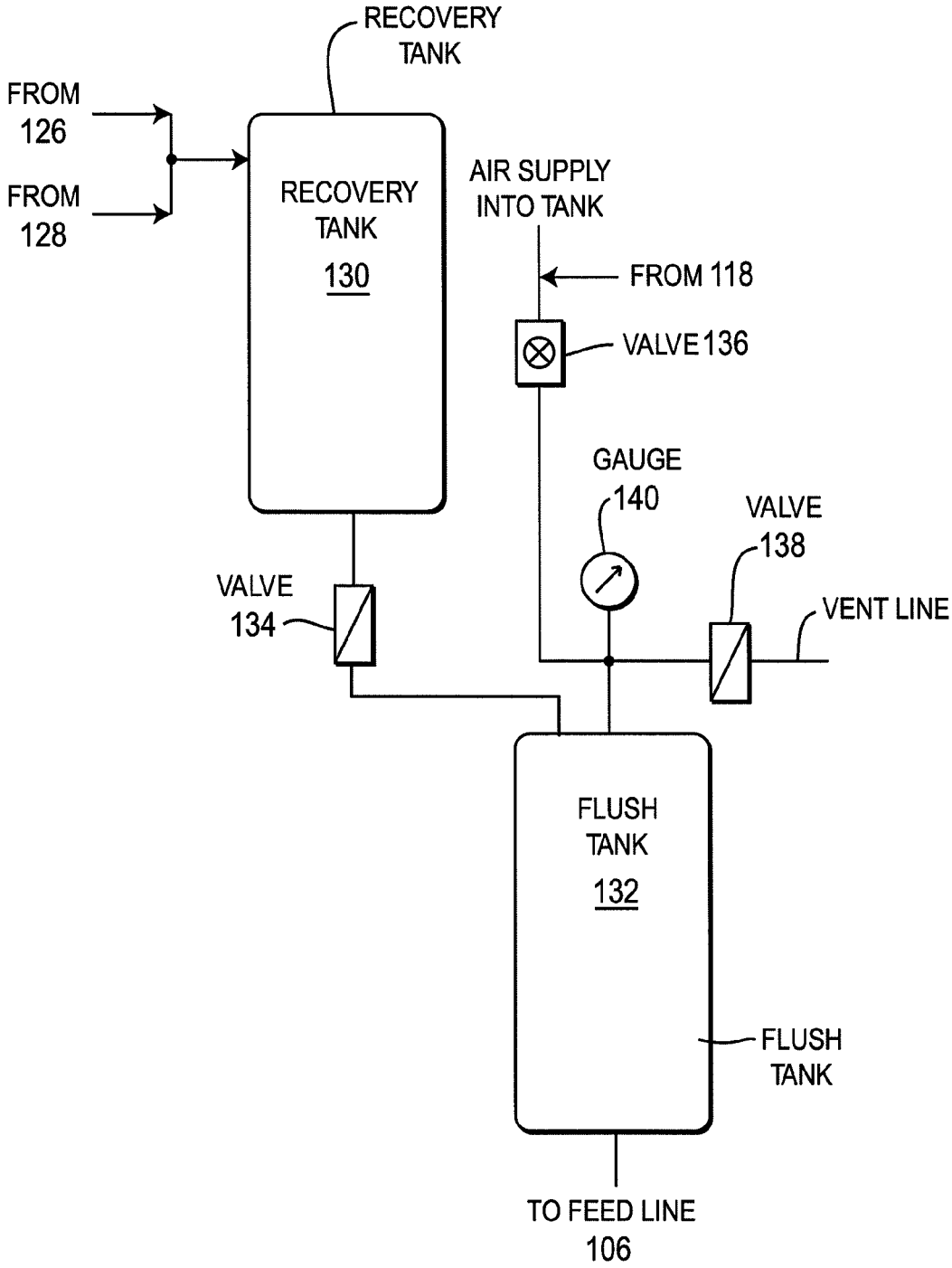
Figure 3D:
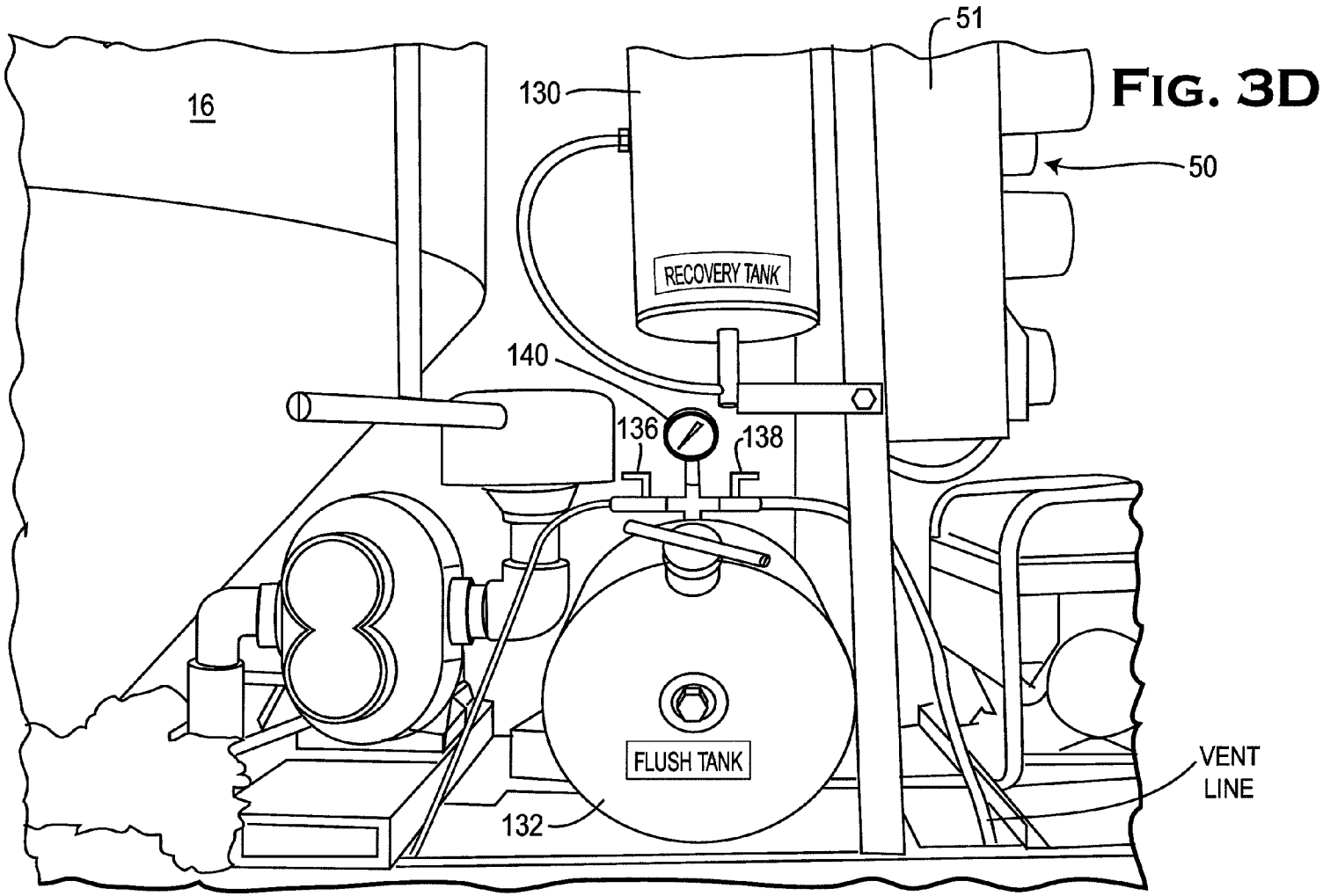

The cleaning agent is returned to flush tank 132 from recovery tank 130 by respectively moving valves 114 and 116 to the 3 o'clock and 9 o'clock positions and closing valve 102 (by moving valve 102 to the 9 o'clock position). The air supply line to flush tank 132 and to the emulsion tank 18 is closed by closing valve 136. The air under pressure in flush tank 132 is vented to the atmosphere by opening valve 138 as shown in FIG. 3C. When the reading of pressure gauge 140 reads "O" (zero) psi, flush tank 132 is now relieved of air pressure.

Closed valve 134 is then opened for 2-3 minutes to drain the recycled cleaning agent, delivered by gravity to recovery tank 130 by lines 126 and 128, back into flush tank 132 and valve 134 is then closed.

The air pressure release valve 138 which bleeds air from tank 132 to the atmosphere is closed and valve 136 is opened to repressurize tank 132 and emulsion supply tank 18 from pressure source 118, completing the back flush operation and retaining all of the solvent and emulsion in the closed system. The connections for the flush operation may be reversed by coupling the flush tank 132 to valves 114 and 116 and coupling the recovery tank 130 to valve 102, if desired.

The Patcher 10 is provided with apparatus for providing a top coat of dry rubber pulverized to form small pieces of a size typically range of 0.00625 to 0.375 inches in diameter and referred to herein as particulate. To accomplish this and making reference to FIG. 4A, hydraulic driven apparatus 210 is provided on the patcher and is comprised of a hydraulic pump 212 for selectively providing hydraulic drive to hydraulically driven blower motor 222 shown in simplified form as being comprised of a hydraulic motor for driving a blower (not shown). An electrically controlled valve 214 driven from a control panel provided in the patcher cabin 18 may be operated to one of a closed, fully opened and a partially opened position by the electrical control in cabin 18 for purposes to be more fully described. A second electrically controlled valve 216 is also operable from the patcher cabin 18 to selectively open or close the flow of hydraulic fluid to a hydraulically driven motor 224 for driving a paddle sprocket forming part of the apparatus for dispensing the pulverized rubber, as will be more fully described.

Figure 4A:
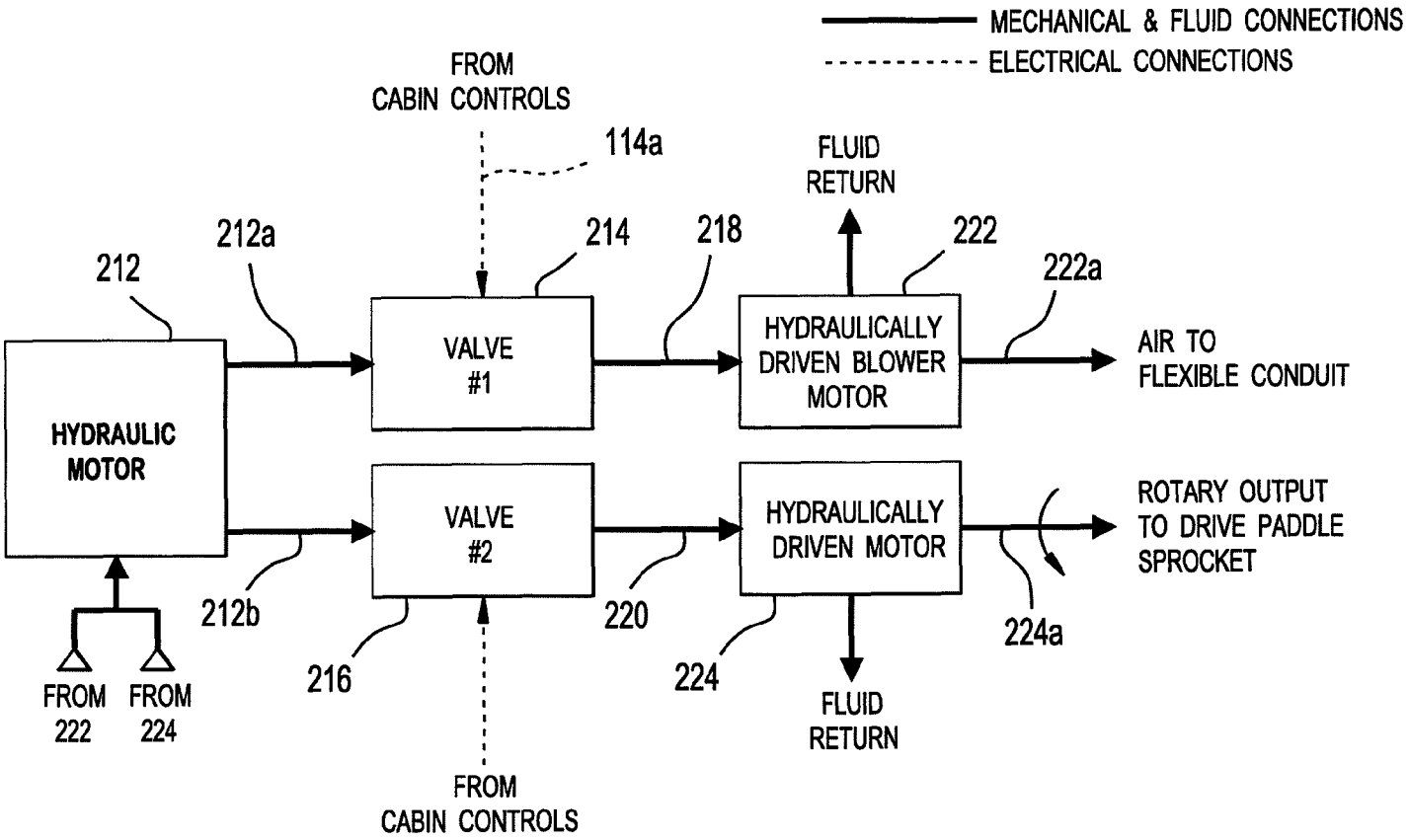
FIGS. 4A-4E show various views of apparatus for feeding constituent matter used in a patching operation.
Figure 4B:
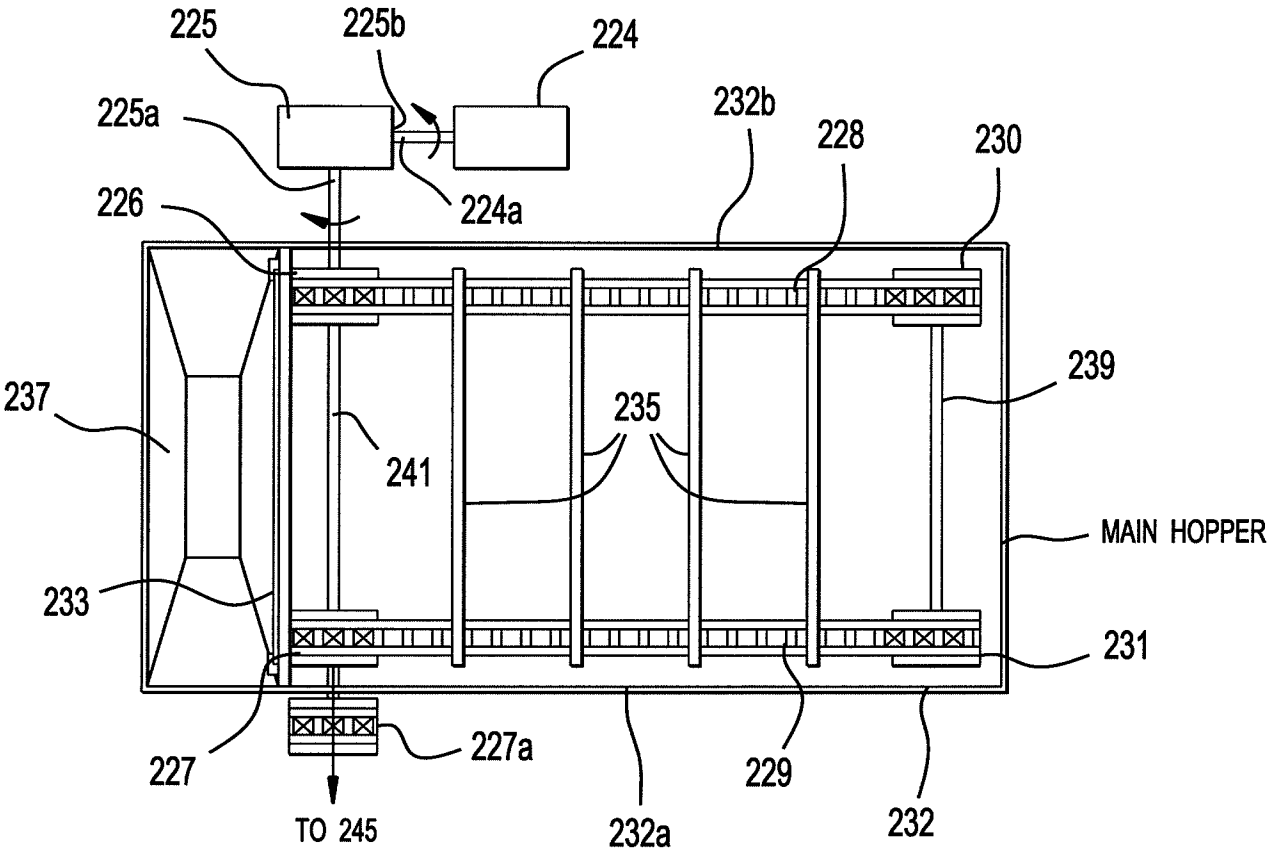
Figure 4C:
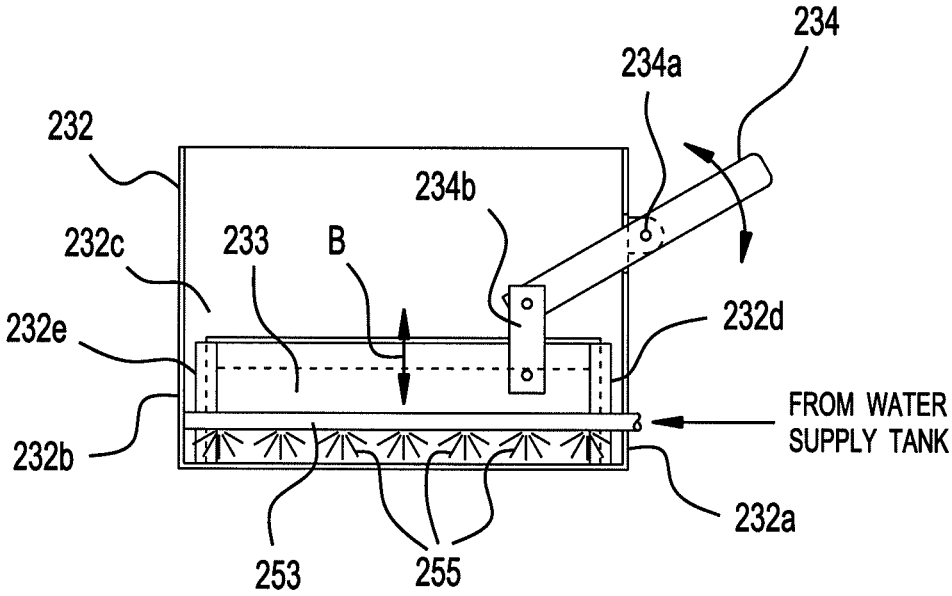
Figure 4D:
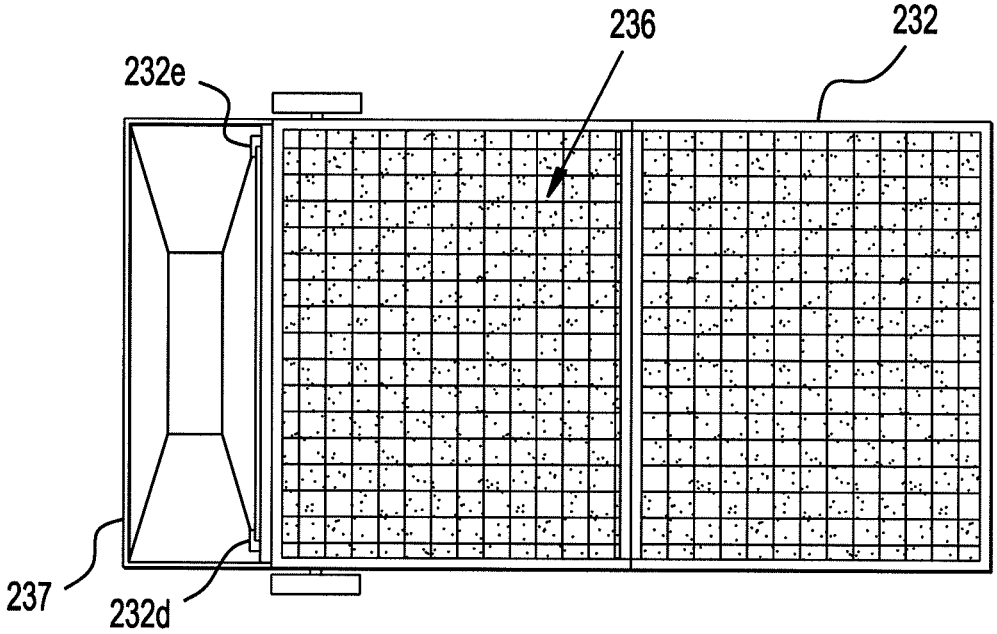
Figure 4E:
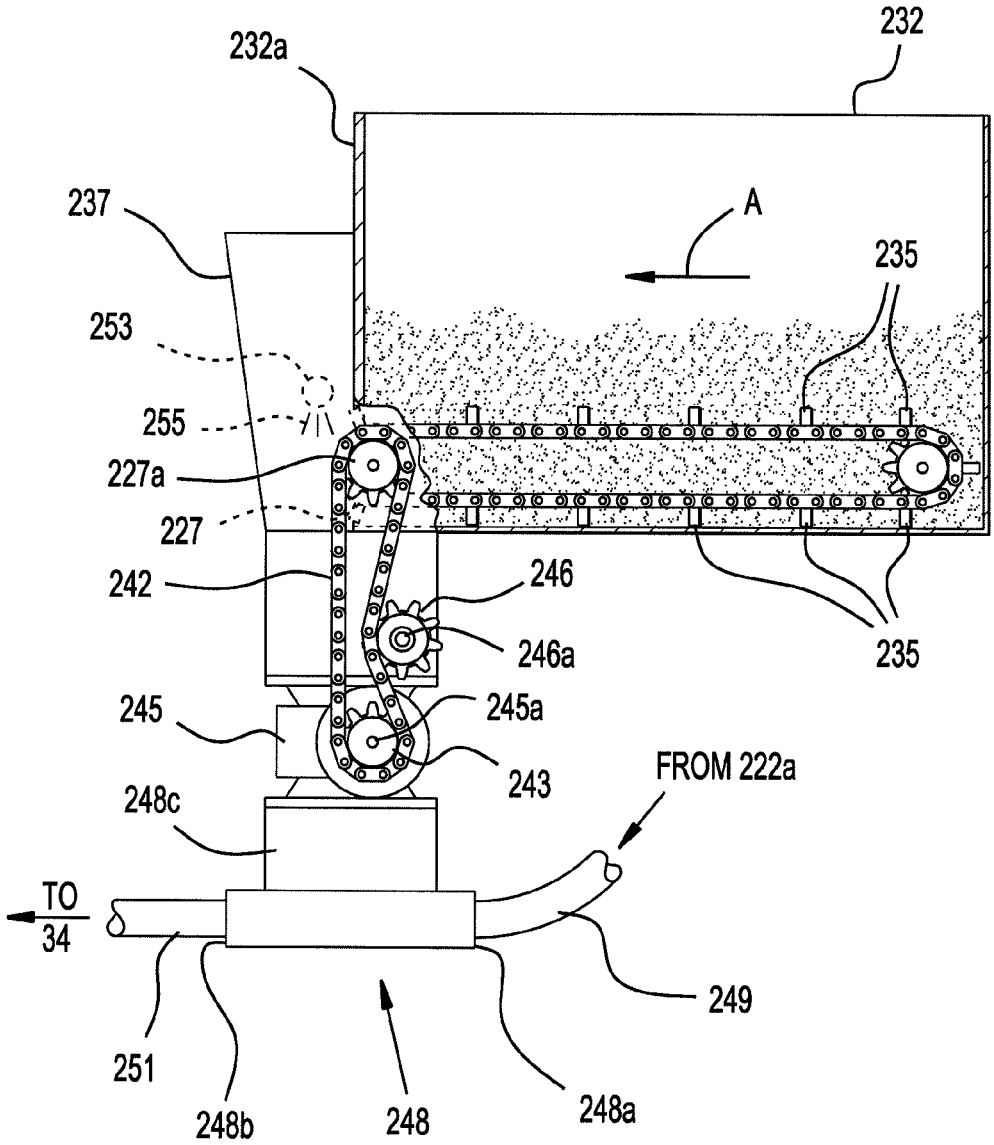

FIG. 4D shows a top plan view of the main hopper 232 and dispensing hopper 237. FIG. 4B shows a top plan view similar to FIG. 4D and showing the details of the paddle driving assembly. FIG. 4E shows a side elevation view of the operable assemblies including further details of the rotary air-lock assembly for driving the particulate from the dispensing hopper 237 into the conduit 249, 251 which delivers air under pressure from the blower, shown in FIG. 4A, to the dispensing head 34 shown in FIG. 3. FIG. 4C shows a view of the adjustable gate 233 having a pivotally mounted operating handle 234 for adjusting the flow of particulate from the main hopper 232 into the dispensing hopper 237. Making reference to FIGS. 4B and 4D, the main hopper 232 is a substantially rectangular-shaped housing having tapering long sides 232*a*, 232*b* and an open top for receiving the shredded rubber or rubber-like material, i.e., particulate. The top of main hopper 232 is provided with a open grate 236 having crossed bars forming an open lattice work to permit the passage of light and air. A pair of closed-loop sprocket chains 228 and 229 are provided with cross members 235 arranged at spaced intervals along the sprocket chains and serve as paddles to advance particulate in the direction shown by arrow A so as to be fed out of the front end 232*a* of main hopper 232 and passed through opening 232*b* in front end 232*a*, as shown in FIG. 4C, and enter into the dispensing hopper 237. A gate 233 has its vertical sides guided within brackets 232*c*, 232*d* arranged along the front end 232*a* of hopper 232. Gate 233 is movable vertically up and down as shown by double-headed arrow B by means of an arm 234 pivoted at 234*a* and pivotally coupled to gate 233 by link 234*b*.

The closed-loop sprocket chains 228 and 229 are entrained about a pair of driven sprockets 230 and 231 mounted to free wheelingly rotate about a shaft 239. Sprocket chains 228 and 229 are further entrained about a pair of drive sprockets 226, 227 rotatable together with shaft 241.

The hydraulically driven motor 224 shown in FIG. 4A is arranged adjacent one side of main hopper 232 and, when hydraulically driven, rotates its output shaft 224*a* to drive an input shaft 225*b* of gear assembly 225, which has its output shaft 225*a* coupled to shaft 241 for rotating drive sprockets 226, 227 as well as sprocket 227*a*.

Drive sprockets 226, 227 and 227*a* are fixedly joined to common shaft 241, whereby rotation of output shaft 225*a* is imparted to sprockets 226, 227 and 227*a*. Making reference to FIG. 4E, closed-loop sprocket chain 242 is entrained about sprocket 227*a* and sprocket 243 mounted on shaft 245*a* of rotary air-lock 245. A tensioning sprocket 246, mounted to rotate about a shaft 246*a*, maintains sprocket chain 242 at the proper tension by adjusting the position of shaft 246*a*. Rotary air-lock 245 may, for example, be a heavy duty drop-through rotary valve type air-lock manufactured by William W. Meyer and Sons, Inc. Particulate delivered to the dispensing hopper 237 from the main hopper 232 by paddles 235 enters into the open upper end of the rotary air-lock and is delivered from its bottom end into a T-coupler 248 having air introduced into its end 248*a* from the blower source whereby particular introduced by the rotary air-lock 245 into branch 248*c* of T-coupler 248 is driven by the air passing through the conduit section 249 for driving the particulate through the opposite end 248*b* of T-coupler 248*b* and into the conduit 251 which delivers the particulate to the dispensing head 34. The rotary valve type air-lock 245 prevents air from passing upward through the air-lock.

During the phase of the patching operation when a pothole is being cleared of debris, valve 214 is electrically operated to open to its maximum size opening for delivering air at maximum pressure to the dispensing head 34. Valve 216 is closed at this time. The aforementioned valve positions of valves 214 and 216, i.e., valve 214 being operated to deliver hydraulic fluid at maximum pressure to blower 222 and valve 216 being closed, are also the positions utilized when heated, flowable material from the storage tank 18 is being fed to the dispensing head 34.

During the operating phase when it is desired to deliver particulate from hopper 232 through the dispensing head 34, valve 214 is operated to provide hydraulic fluid to the blower motor at a reduced pressure causing the output of the blower to be reduced to accommodate a reduced air flow, which is adequate for delivery of the particulate from main hopper 232. Simultaneously with the operation of valve 214 to the position to reduce hydraulic fluid pressure to the hydraulic motor for the blower, valve 216 is opened to deliver hydraulic fluid to the hydraulically driven motor 224 for rotating drive sprocket 226 through gear assembly 225, which couples the rotary drive from hydraulically driven motor 224 to the shaft 241 upon which sprocket 226 is mounted, thereby rotating shaft 241 and drive sprockets 226 and 227 to move sprocket chains 228 and 229 and paddles 235 in order to deliver the particulate in main hopper 232 to dispensing hopper 237 through opening 232*b* under the control of the paddles 235. The drive imparted to shaft 241 is delivered to the rotary air-lock 245 by sprocket 227*a*, sprocket chain 242 and driven sprocket 243.

The time interval during which the particulate from main hopper 232 is dispensed from the dispensing head 34 for deposit upon the surface of a filled pothole may be controlled by observation by the operator in the patcher cabin 18 of the depositing operation, the deposit operation being easily observed from the cabin 18 since the dispensing head is fully in view of the operator during the dispensing operation. Alternatively, or in addition, an adjustable timer may be provided as part of the controls for operating valves 214 and 216 as well as adjusting gate 232*a* to control the rate of flow of particulate from main hopper 232 into dispensing hopper 237.

The apparatus shown in FIGS. 4A through 4E can be further configured for use in feeding particulate to the dispensing head for mixing with heated flowable material, such as emulsion, from the storage tank 18 for use in coating and/or filling potholes. In view of the fact that the heated emulsion delivered from storage tank 18 does not bond to the rubber particulate, it has been discovered that using a particulate derived from rubber impregnated with fibrous material such as, for example, any of the fibers employed in the production of fiber-reinforced automobile tires, solves the bonding problem. The particulate may alternatively be produced by admixing fibers with rubber to form a firm bond therebetween and then converting the resulting composition into particulate. Alternatively, substantially the same result may be obtained by recycling used tires of the fiber-reinforced type to be converted into particulate. The fibers in the rubber form an excellent bond and when admixed with the emulsion, the emulsion forms an excellent bond with the fibers providing a composition for coating and/or filling potholes which provides a useful operating life over long periods of use. By pre-spraying the material with a liquid bonding agent this significantly improves adhesion. This is preferably performed at the nozzle assembly 34*h* located at the front of the boom shown in FIGS. 1A, 2B and 3. Other advantages include providing tensile strength and a webbing effect.

The particulate of rubber firmly bonded to fibrous material is delivered from the main hopper 132 in substantially the same manner as the particulate which does not contain any fibrous material. The particulate of rubber bonded with fibrous material is combined at the dispensing head with emulsion from the heated storage tank 18.

As another alternative, the particulate may be fibrous material which has been shredded and/or otherwise processed for feeding into the dispensing head 34 to be admixed with flowable material from the storage tank 18. Since the individual fibers are nearly weightless as a practical matter, apparatus as shown in FIG. 4E is utilized to effectively feed the fibers into the dispensing hopper 237. Making reference to FIGS. 4C and 4E, a water supply source (not shown for purposes of simplicity) is coupled through a suitable conduit to a hollow, elongated spray tube 253 extending across the flow of fibers, also shown in dotted fashion in the side view shown in FIG. 4E, and provided with a plurality of openings along the underside thereof to provide a fine spray 255 for spraying the fibrous material delivered from main hopper 232 into dispensing hopper 237 in order to assure that the fibrous material is delivered into the dispensing hopper and downwardly through the rotary air lock 245. It should be understood that this operation is performed simultaneously with the delivery of heated flowable repair material from storage tank 18 through conduit 249-251. The fibrous material provides added tensile strength to the resultant composition as well as creating a webbing effect.

What is claimed is:

1. An apparatus for introducing particulate into a conduit, comprising:

a hopper having an inlet for receiving particulate to be dispensed and having an outlet;

a conveying assembly for advancing particulate to the hopper inlet;

a hydraulic pump;

a blower for introducing air into said conduit to move particulate along said conduit;

a first hydraulic motor selectively coupled to said hydraulic pump for driving said blower; and a second hydraulic motor selectively coupled to said hydraulic pump for driving said conveying assembly;

a feeder assembly, separate from the blower, that is responsive to mechanical drive provided to said conveying assembly by said second hydraulic motor for introducing said particulate into said conduit, the feeder assembly being configured to prevent air from the blower from entering the hopper when particulate passes through the feeder assembly, wherein said conveying assembly comprises a paddle assembly arranged in a housing containing particulate and in communication with the hopper; said paddle assembly comprising first and second closed-loop sprocket chains arranged in spaced parallel fashion;

a first pair of drive sprockets mounted upon a common shaft for rotating said drive sprocket chains responsive to rotary drive coupled to said common shaft by a gear assembly coupled between the common shaft and the second hydraulic motor;

a second pair of rotatably mounted driven sprockets;

said closed-loop drive chains each engaged by one of the pair of drive sprockets and one of the pair of driven sprockets;

paddle members coupled at spaced intervals to said first and second sprocket chains for conveying particulate from said housing to said hopper inlet during rotation of said common shaft; and a third closed-loop sprocket chain for rotating a single, driven sprocket mounted on an input shaft of a rotary air-lock for driving said rotary air-lock during operation of said second hydraulic motor to feed particulate from said hopper into the conduit, whereby said second hydraulic motor imparts a driving force to said paddle assembly and said rotary air-lock.

2. The apparatus of claim 1 wherein the particulate is ground up rubber.

3. The apparatus of claim 1 wherein the particulate is comprised of ground up tires.

4. The apparatus of claim 1 wherein the particulate is comprised of rubber bonded with a fibrous material.

5. The apparatus of claim 1 wherein the particulate is a fibrous material.

6. The apparatus of claim 1 further comprising first and second electrically-operated valves for selectively coupling hydraulic power from said hydraulic pump to an associated one of said first and second hydraulic motors.

7. The apparatus of claim 1 further comprising a gear assembly coupled between said second hydraulic motor and said conveying assembly for changing a rotating speed at an outlet of the second hydraulic motor to drive the conveying assembly at a different rotating speed.

8. The apparatus of claim 1 wherein said feeder assembly comprises said rotary air-lock.

9. The apparatus of claim 6 wherein said first electrically-operated valve has at least first and second operating positions, the first operating position configured for coupling a first given hydraulic power level to said first hydraulic motor for delivering particulate from said hopper to said conduit.

10. The apparatus of the claim 6 wherein said second electrically-operated valve has a first position preventing delivery of hydraulic power to said second hydraulic motor and a second position for delivering hydraulic power to said second hydraulic motor to drive the conveying assembly.

11. The apparatus of claim 1, wherein said hopper is tapered and the inlet for receiving particulate from the conveying assembly is larger than the outlet, which is configured to convey particulate by gravity to the feeder assembly.

12. The apparatus of claim 1 further comprising a T-coupler having a hollow main portion inserted at a given position along said conduit for delivering air in said conduit through said main portion and a hollow branch portion communicating with said main portion for delivering particulate from said feeder assembly into said main portion whereby particulate entering said main portion from said branch portion is conveyed out of said main portion by said air flow.

13. The apparatus of claim 1 wherein said feeder assembly comprises a rotary air-lock configured to prevent the air flow in the conduit from entering said rotary air-lock.

14. The apparatus of claim 1 further comprising a spray mechanism for spraying a liquid on particulate passing into the hopper, the spray mechanism being configured to provide a controlled spray to facilitate downward movement of particulate into said hopper.

15. The apparatus of claim 1 wherein the particulate is a light, fibrous matter.

* * * * *

UNITED STATES PATENT AND TRADEMARK OFFICE

CERTIFICATE OF CORRECTION

PATENT NO. : 8,562,248 B2
APPLICATION NO. : 12/871435
DATED : October 22, 2013
INVENTOR(S) : Scott P. Kleiger It is certified that error appears in the above-identified patent and that said Letters Patent is hereby corrected as shown below:

IN THE SPECIFICATION

Column 4, Lines 63-64, delete "mixing heat 34." and insert -- mixing head 34. --, therefor.

Column 7, Line 51, delete "a open" and insert -- an open --, therefor.

Column 9, Line 31, delete "main hopper 132" and insert -- main hopper 232 --, therefor.

Signed and Sealed this
Eighteenth Day of February, 2014

Michelle K. Lee

Michelle K. Lee
*Deputy Director of the United States Patent and Trademark Office*